US011228151B1

(12) United States Patent
Chiu et al.

(10) Patent No.: US 11,228,151 B1
(45) Date of Patent: Jan. 18, 2022

(54) ANGULAR CONNECTOR

(71) Applicant: GT CONTACT CO., LTD., New Taipei (TW)

(72) Inventors: Jui-Jung Chiu, Taoyuan County (TW); Chien-Chung Chiu, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 0 days.

(21) Appl. No.: 16/930,323

(22) Filed: Jul. 16, 2020

(51) Int. Cl.

| | |
|---|---|
| ***H01R 24/60*** | (2011.01) |
| ***H01R 13/64*** | (2006.01) |
| ***H01R 13/504*** | (2006.01) |
| ***H01R 12/72*** | (2011.01) |
| ***H01R 13/516*** | (2006.01) |
| *H01R 107/00* | (2006.01) |
| *H01R 13/52* | (2006.01) |
| *H01R 13/46* | (2006.01) |
| *H01R 13/50* | (2006.01) |

(52) U.S. Cl.
CPC ..... *H01R 24/60* (2013.01); *H01R 12/724* (2013.01); *H01R 13/504* (2013.01); *H01R 13/516* (2013.01); *H01R 13/64* (2013.01); *H01R 13/46* (2013.01); *H01R 13/50* (2013.01); *H01R 13/52* (2013.01); *H01R 13/5205* (2013.01); *H01R 2107/00* (2013.01)

(58) Field of Classification Search
CPC .... H01R 24/60; H01R 13/516; H01R 13/504; H01R 12/724; H01R 13/64; H01R 13/52; H01R 13/50; H01R 13/5205; H01R 13/46; H01R 2107/00
See application file for complete search history.

(56) References Cited

U.S. PATENT DOCUMENTS

2019/0356078 A1* 11/2019 Li ..... H01R 12/707

FOREIGN PATENT DOCUMENTS

| | | | |
|---|---|---|---|
| TW | M426185 U1 | | 4/2012 |
| TW | M600961 U | * | 4/2020 |
| TW | M600961 U | | 9/2020 |

* cited by examiner

*Primary Examiner* — Abdullah A Riyami
*Assistant Examiner* — Justin M Kratt
(74) *Attorney, Agent, or Firm* — Li & Cai Intellectual Property Office

(57) ABSTRACT

An angular connector and a manufacturing method thereof are provided. The angular connector includes a plug, a transmission cable connected to the plug, an inner molding body covering part of the plug and part of the transmission cable, a positioning case fastened to the plug, and an outer molding body that is connected to the inner molding body and the positioning case. The plug has an insertion slot recessed in an end of the insertion portion. An insertion portion of the plug is maintained to be exposed from the positioning case by an insertion length along the insertion direction, and the insertion length is within a range of 6.5 mm to 6.8 mm. The outer molding body and the positioning case jointly define a corner structure having an angle that is greater than or equal to 90 degrees and that is less than 180 degrees.

9 Claims, 12 Drawing Sheets

ANGULAR CONNECTOR

FIELD OF THE DISCLOSURE

The present disclosure relates to a cable connector, and more particularly to an angular connector and a manufacturing method thereof.

BACKGROUND OF THE DISCLOSURE

A conventional cable connector includes a plug, a cable connected to the plug, and a molding compound that covers the plug and the cable. However, the molding compound is formed in an injection molding manner, so that when the molding compound needs to have a corner of a specific angle, the forming process of the molding compound easily results in a displacement or an overturning of the plug, thereby reducing the production yield.

SUMMARY OF THE DISCLOSURE

In response to the above-referenced technical inadequacies, the present disclosure provides an angular connector and a manufacturing method thereof to effectively improve on the issues associated with conventional cable connectors.

In one aspect, the present disclosure provides an angular connector, which includes a plug, a transmission cable, an inner molding body, a positioning case, and an outer molding body. The plug includes an insertion portion and an assembling portion. The plug has an insertion slot that is recessed in an end of the insertion portion away from the assembling portion and that extends along an insertion direction. The transmission cable has an embedded segment, an exposed segment, and a buffering segment that connects the embedded segment and the exposed segment. The embedded segment is connected to the assembling portion of the plug, and the transmission cable is electrically coupled to the plug. The inner molding body covers the embedded segment and at least part of the assembling portion of the plug. The positioning case is fastened to the plug and surrounds the plug so as to maintain the insertion portion of the plug to be exposed from the positioning case by an insertion length along the insertion direction. The insertion length is within a range of 6.5 mm to 6.8 mm. The outer molding body covers and is connected to the inner molding body and the buffering segment of the transmission cable. The outer molding body is connected to an inner surface of the positioning case, but is not connected to the insertion portion of the plug. The outer molding body and the positioning case jointly define a corner structure having an angle that is greater than or equal to 90 degrees and that is less than 180 degrees.

In certain embodiments, the plug defines a width direction and a longitudinal direction that are perpendicular to each other and that are perpendicular to the insertion direction, a width of the positioning case along the width direction is within a range of 6.3 mm to 6.5 mm, and the angle of the corner structure is defined in a plane perpendicular to the longitudinal direction.

In certain embodiments, the plug defines a width direction and a longitudinal direction that are perpendicular to each other and that are perpendicular to the insertion direction, a width of the positioning case along the width direction is within a range of 6.3 mm to 6.5 mm, and the angle of the corner structure is defined in a plane perpendicular to the width direction.

In another aspect, the present disclosure provides a manufacturing method of an angular connector, which includes a preparation step, a first injection step, a mediation step, and a second injection step. The preparation step is implemented by providing a plug and a transmission cable. The plug includes an insertion portion and an assembling portion connected to the transmission cable, and the plug has an insertion slot that is recessed in an end of the insertion portion away from the assembling portion and that extends along an insertion direction. The first injection step is implemented by forming an inner molding body to cover the assembling portion and a portion of the transmission cable adjacent to the assembling portion. The mediation step is implemented by fastening a positioning case to the plug so as to maintain the insertion portion of the plug to be exposed from the positioning case by an insertion length along the insertion direction. The insertion length is within a range of 6.5 mm to 6.8 mm. The second injection step is implemented by forming an outer molding body connected to the inner molding body and an inner surface of the positioning case, so that the outer molding body and the positioning case jointly define a corner structure. The outer molding body is not connected to the insertion portion of the plug, and the corner structure has an angle that is greater than or equal to 90 degrees and that is less than 180 degrees.

Therefore, by virtue of "the positioning case is fastened to the plug and surrounds the plug, so that the insertion portion of the plug can be maintained to be exposed from the positioning case by an insertion length along the insertion direction, and the insertion length is within a range of 6.5 mm to 6.8 mm", the angular connector and the manufacturing method of the present disclosure thereby ensures that when the plug of the angular connector is inserted into the mating connector, the insertion portion can be effectively and firmly electrically coupled to the mating connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
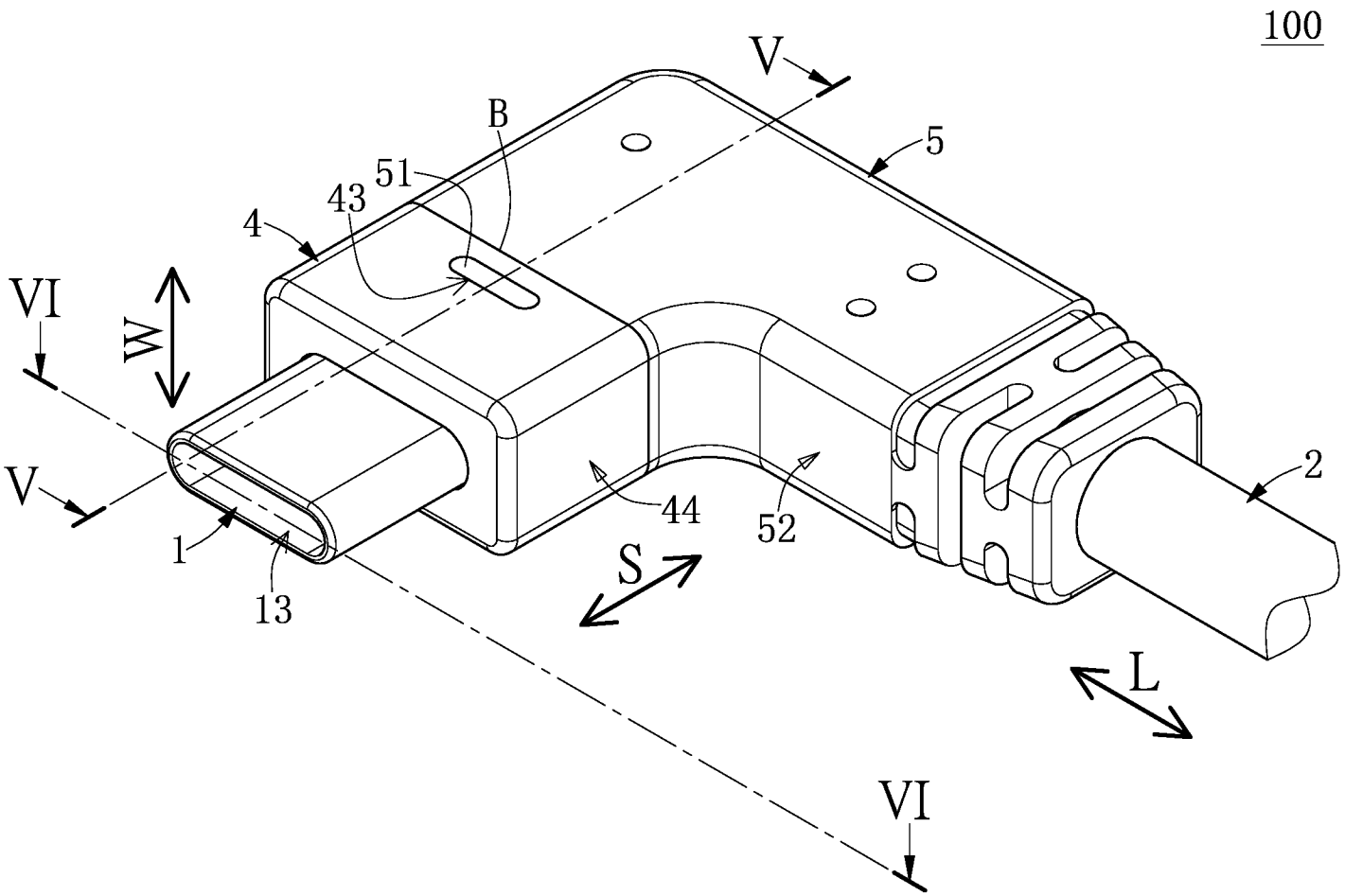
FIG. 1 is a perspective view of an angular connector according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
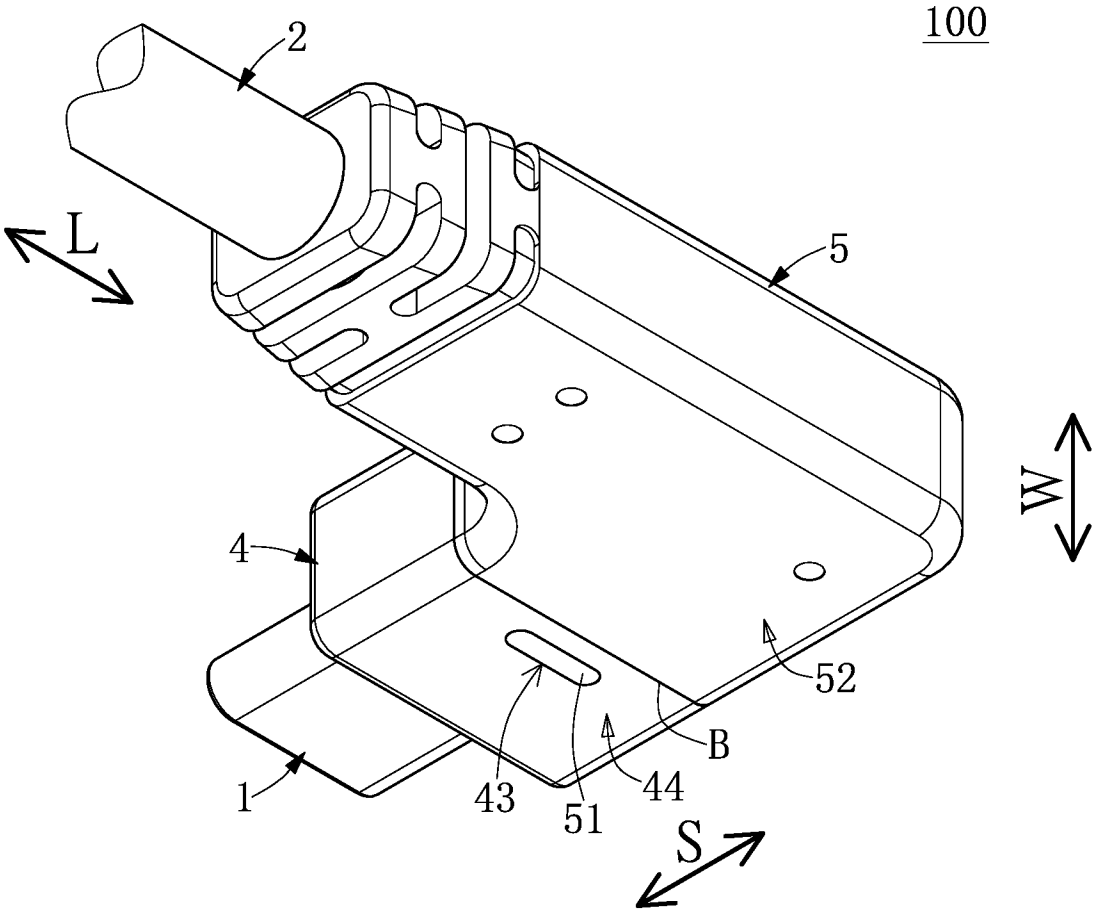
FIG. 2 is a perspective view showing the angular connector of FIG. 1 from another angle of view.
Figure 3:
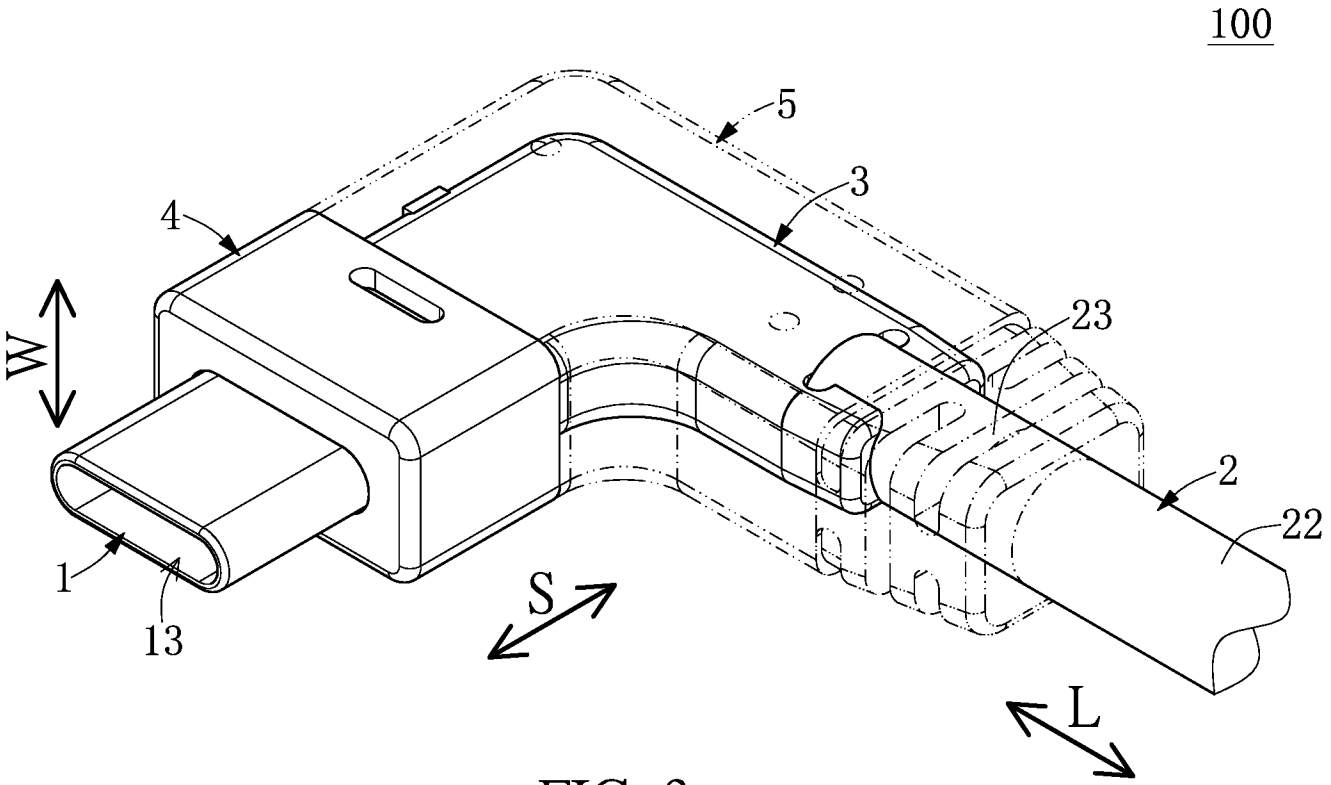
FIG. 3 is a partial perspective view of FIG. 1 when an outer molding body is omitted.

Referring to FIG. 1 to FIG. 7, a first embodiment of the present disclosure provides an angular connector 100 that is preferably a USB 3.0 type C cable connector, but the present disclosure is not limited thereto. As shown in FIG. 1 to FIG. 3, the angular connector 100 in the present embodiment includes a plug 1, a transmission cable 2 connected to the plug 1, an inner molding body 3 covering a part of the plug 1 and a part of the transmission cable 2, a positioning case 4 fastened to the plug 1, and an outer molding body 5 that is connected to the inner molding body 3 and the positioning case 4. The following description describes the structure and connection relationship of each component of the angular connector 100.

Figure 4:
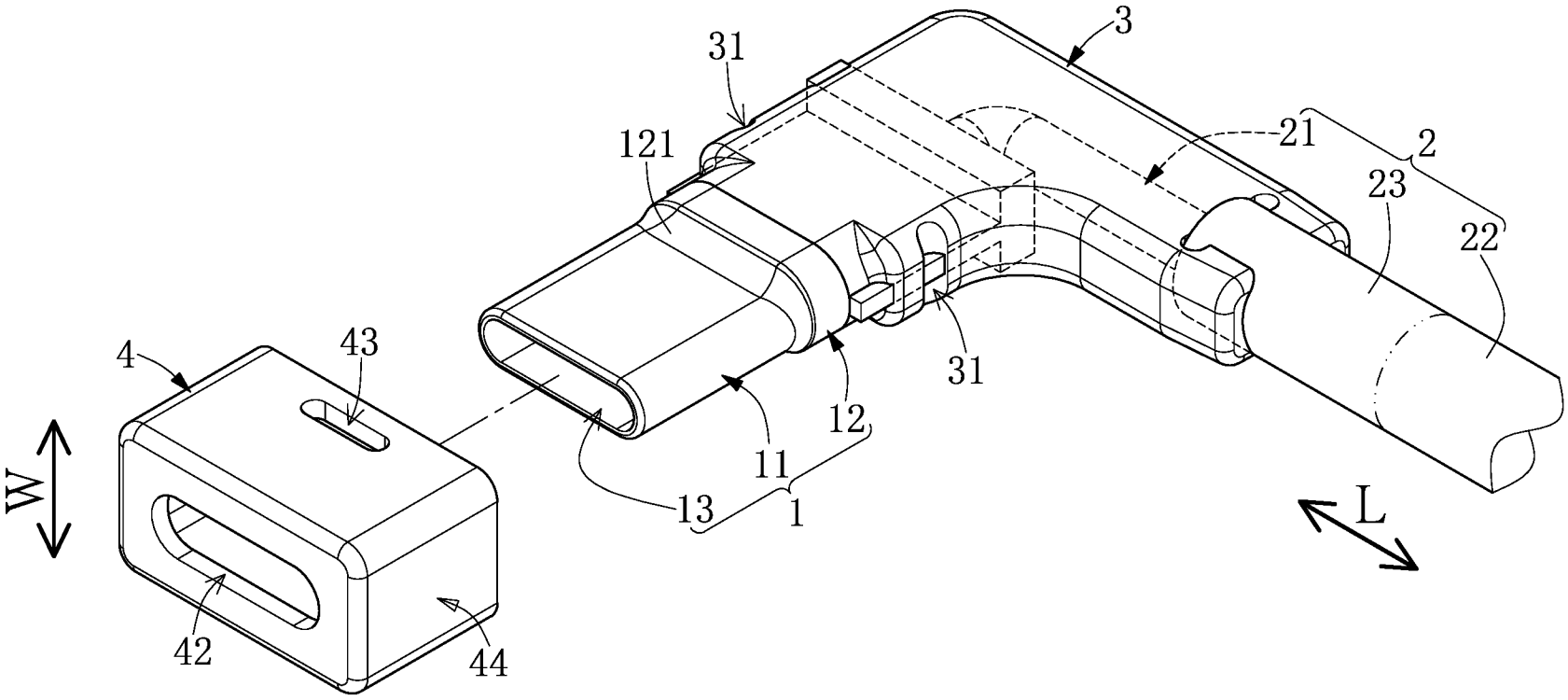
FIG. 4 is an exploded view of FIG. 3.
Figure 5:
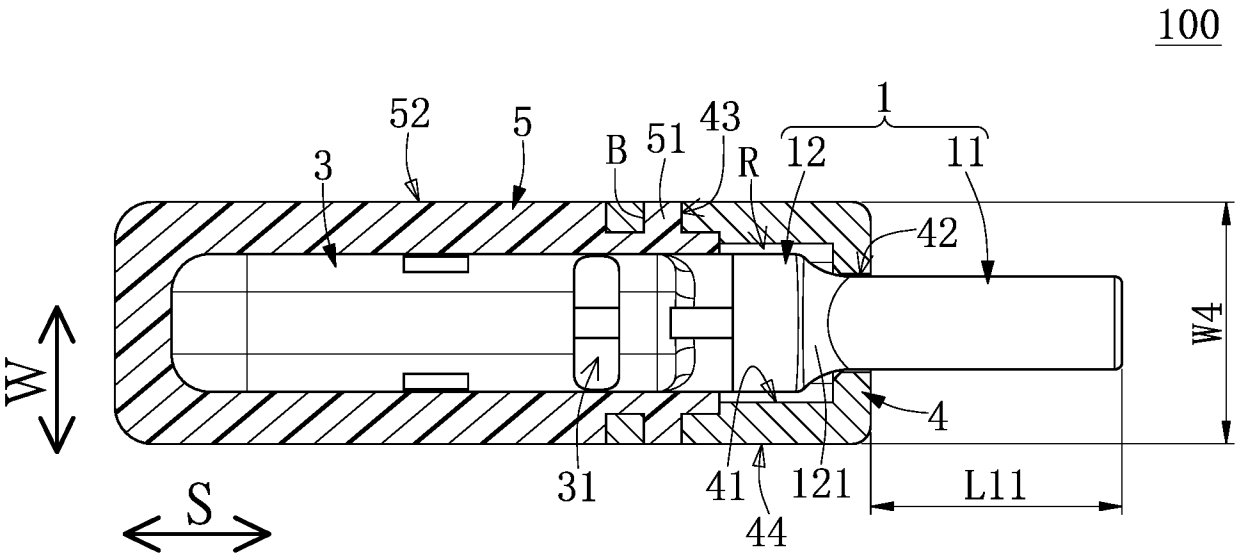
FIG. 5 is a cross-sectional view taken along line V-V of FIG. 1.
Figure 6:
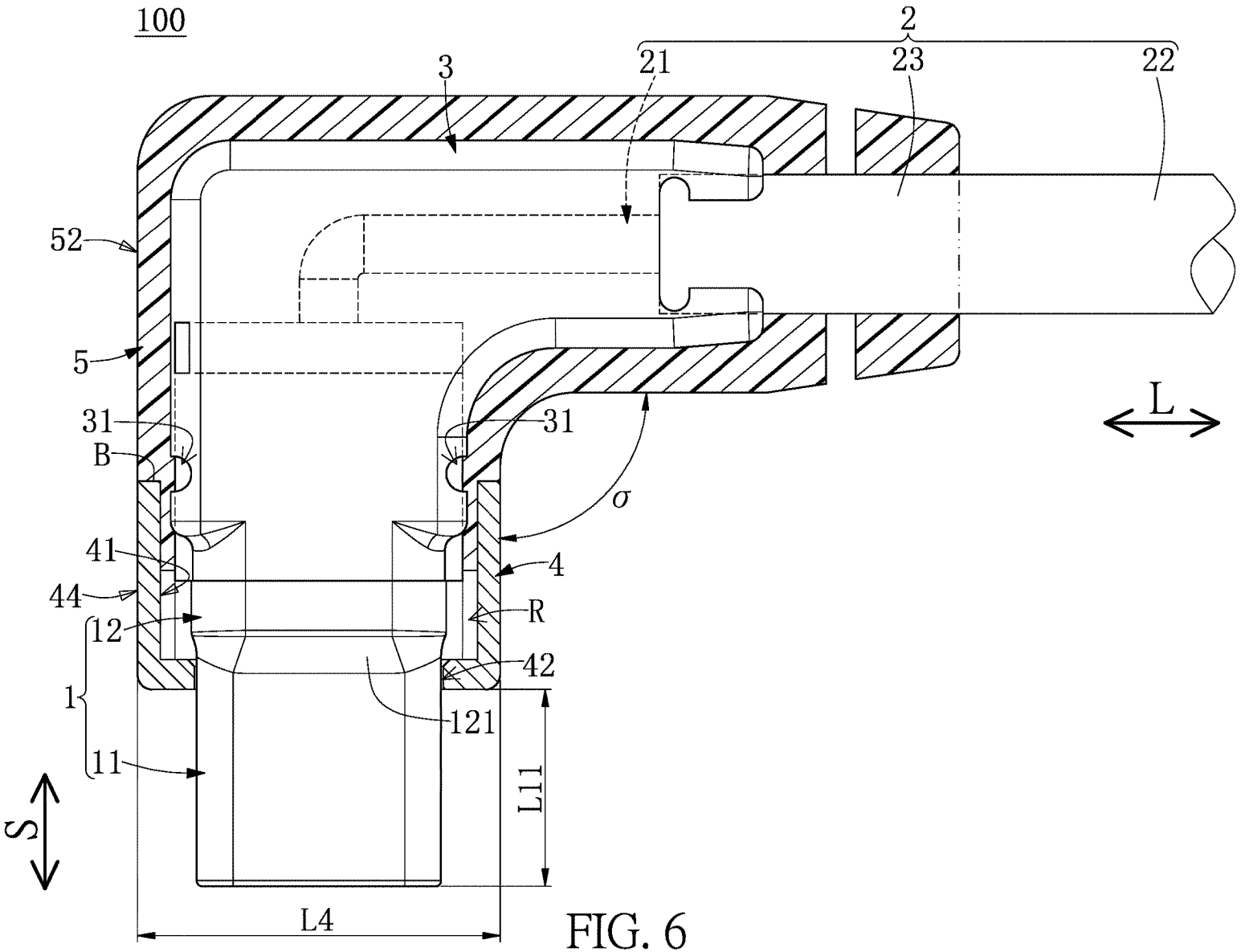
FIG. 6 is a cross-sectional view taken along line VI-VI of FIG. 1.
Figure 7:
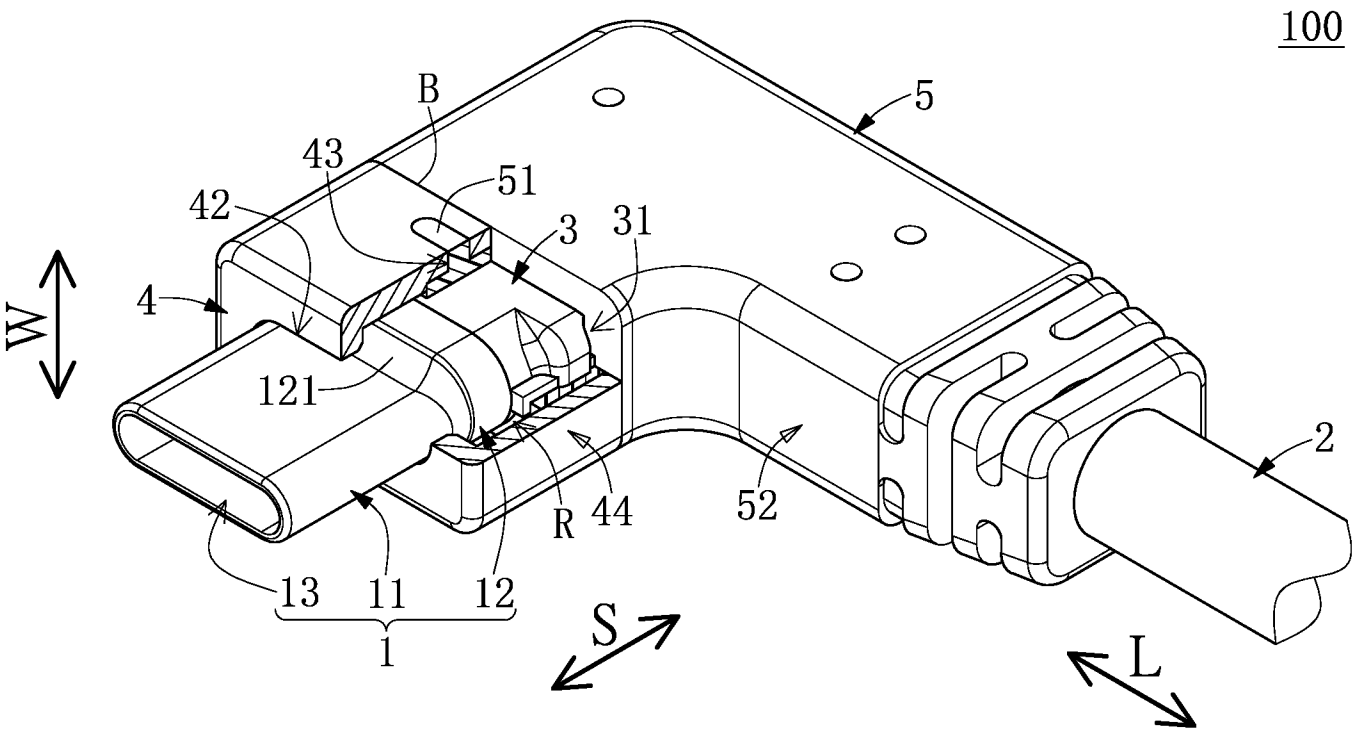
FIG. 7 is a partial cross-sectional perspective view of FIG. 1.
Figure 8:
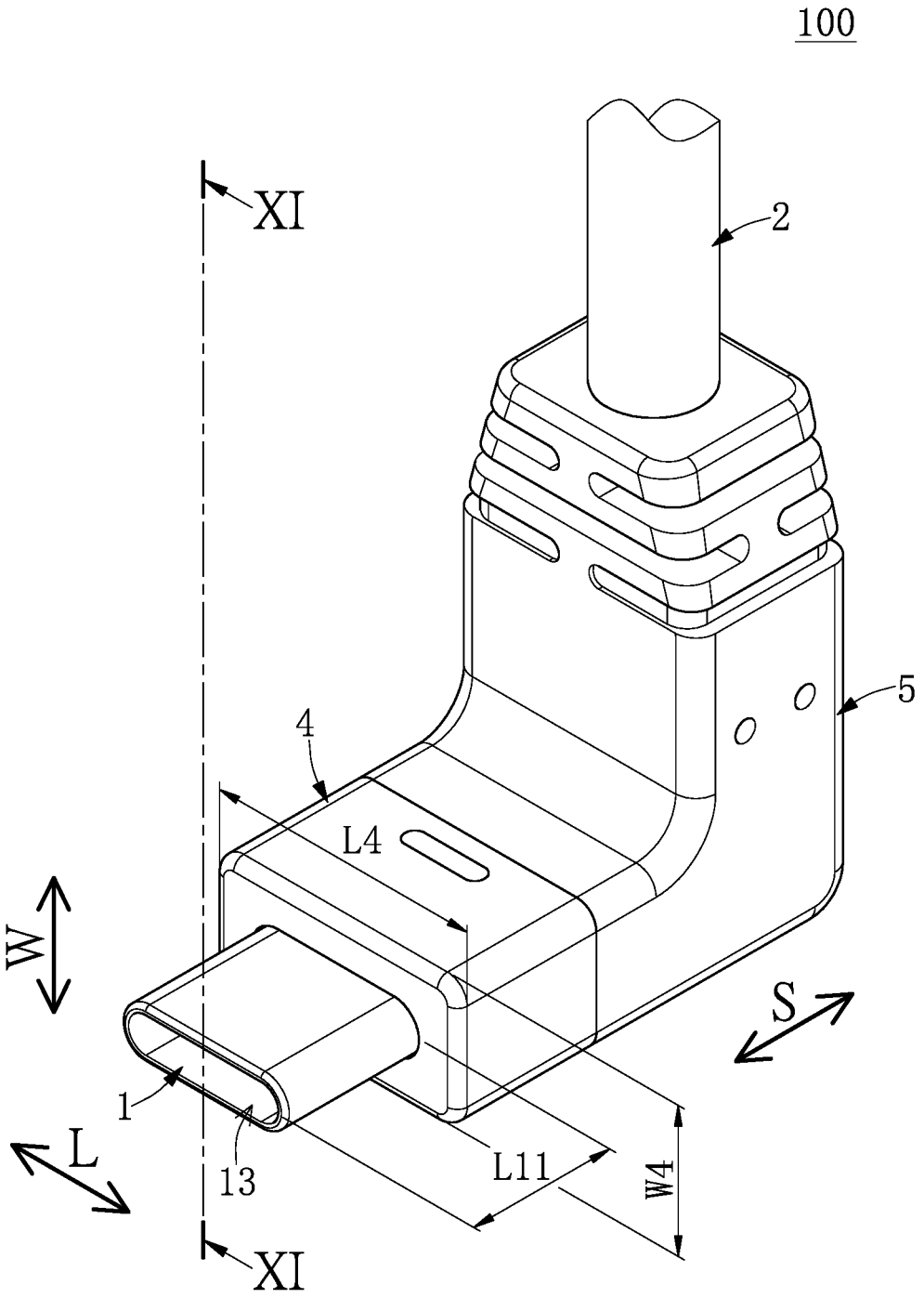
FIG. 8 is a perspective view of an angular connector according to a second embodiment of the present disclosure.
Figure 9:
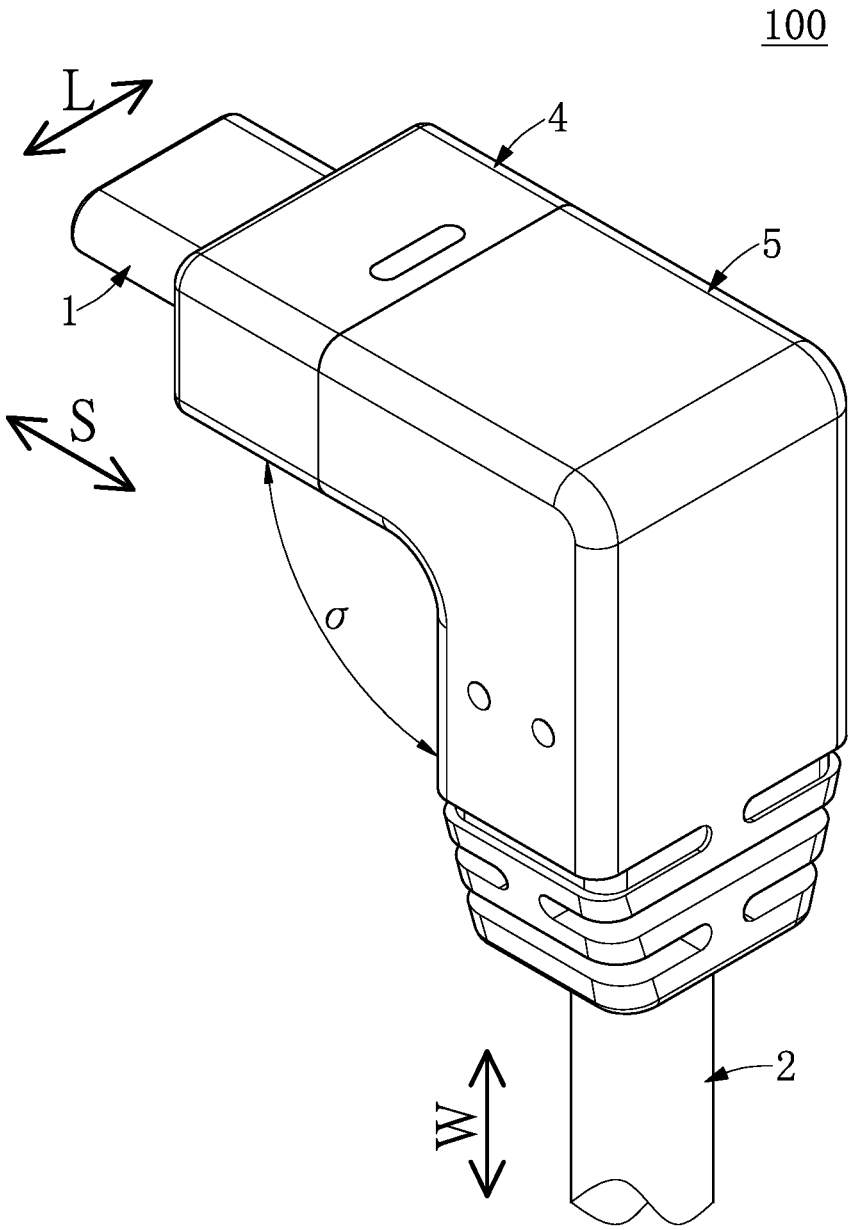
FIG. 9 is a perspective view showing the angular connector of FIG. 8 from another angle of view.
Figure 10:
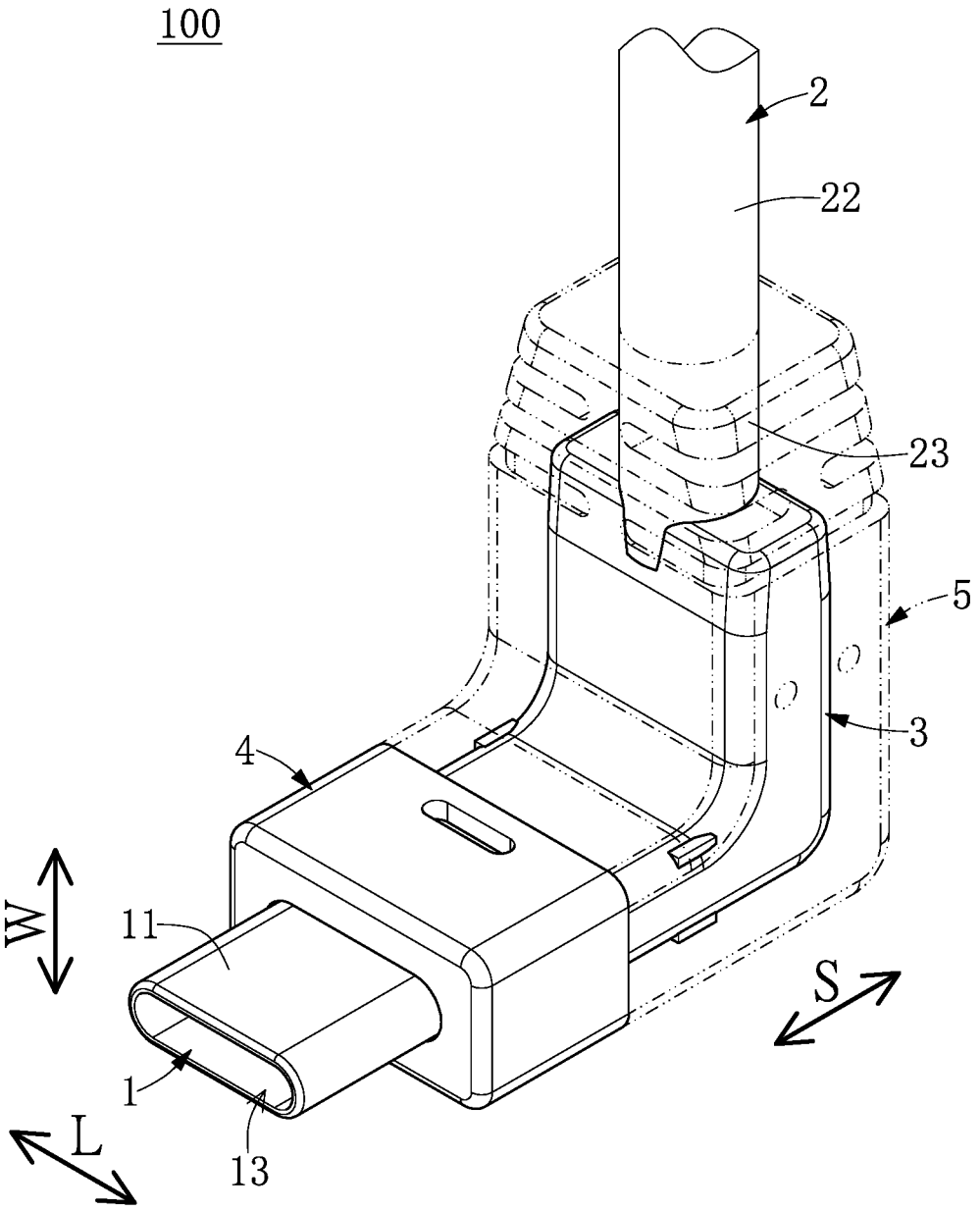
FIG. 10 is a partial perspective view of FIG. 8 when an outer molding body is omitted.
Figure 11:
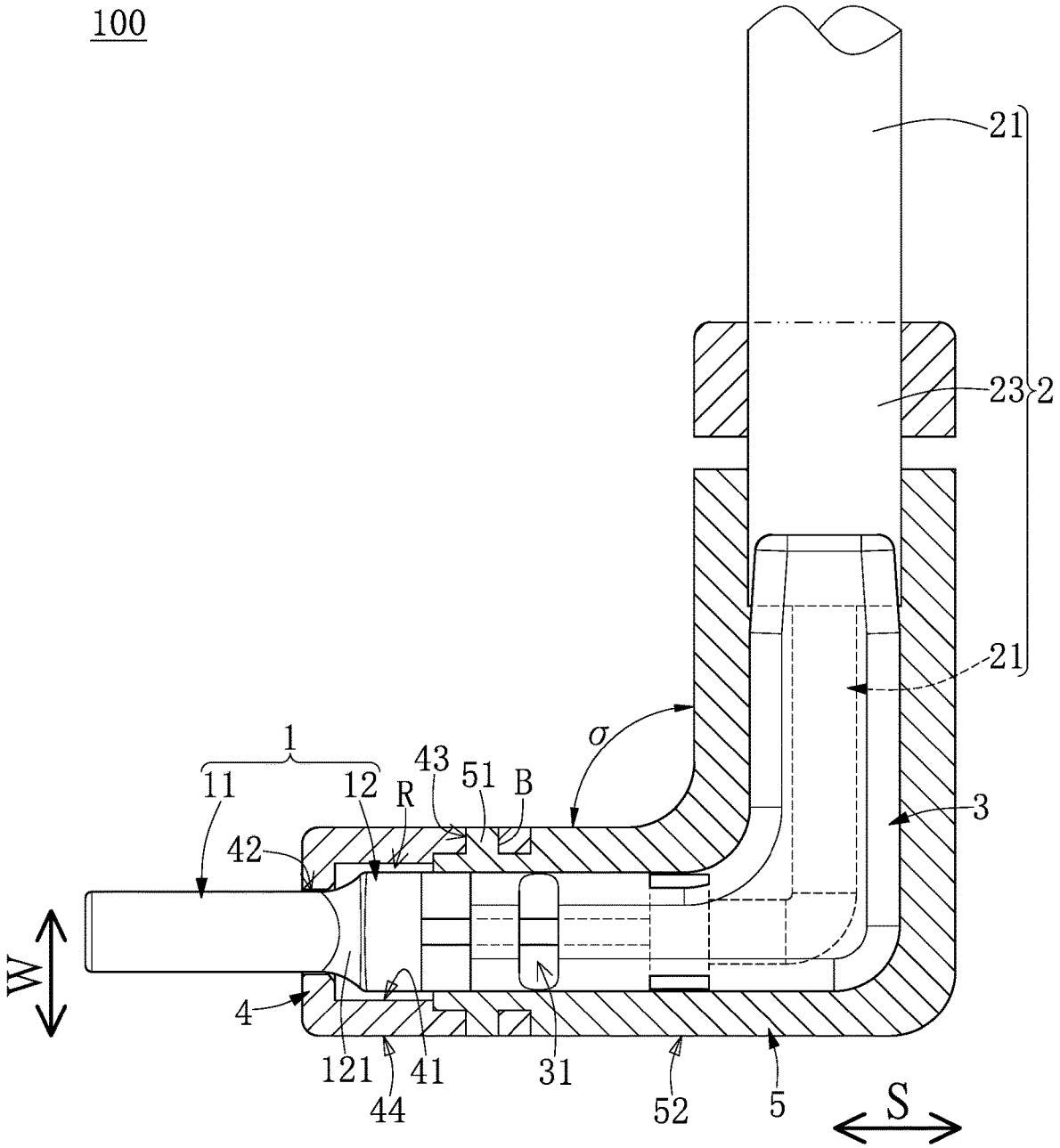
FIG. 11 is a cross-sectional view taken along line XI-XI of FIG. 8.

As shown in FIG. 4, the plug 1 includes an insertion portion 11 and an assembling portion 12 that is connected to the insertion portion 11. In other words, the insertion portion 11 is configured to insert into a mating connector (not shown in the figures) along an insertion direction S so as to electrically couple to the mating connector. In addition, in order to clearly describe a structure of the angular connector 100, the plug 1 in the present embodiment defines a width direction W and a longitudinal direction L that are perpendicular to each other and perpendicular to the insertion direction S.

The plug 1 has an insertion slot 13 recessed from an end of the insertion portion 11 away from the assembling portion 12 (e.g., a left end of the insertion portion 11 shown in FIG. 4), and the insertion slot 13 extends along the insertion direction S. Specifically, the plug 1 in the present embodiment includes a plurality of terminals (not shown in the figures) that are arranged in the insertion slot 13 and that are distributed according to the standard of type C of USB 3.0, but the present disclosure is not limited thereto.

The transmission cable 2 includes an embedded segment 21, an exposed segment 22, and a buffering segment 23 that connects the embedded segment 21 and the exposed segment 22. The embedded segment 21 is connected to the assembling portion 12 of the plug 1, and the transmission cable 2 is electrically coupled to the plug 1. In other words, the transmission cable 2 can be electrically coupled to the terminals of the plug 1 by the connection of the embedded segment 21 and the assembling portion 12.

The inner molding body 3 covers the embedded segment 21 of the transmission cable 2 and at least part of the assembling portion 12 of the plug 1. In other words, the inner molding body 3 covers the connection portion of the transmission cable 2 and the plug 1, and the inner molding body 3 in the present embodiment is substantially in an L-shape, but the present disclosure is not limited thereto. Moreover, a portion of the inner molding body 3 covering the at least part of the assembling portion 12 (e.g., the left portion of the inner molding body 3 shown in FIG. 4) has a plurality of concavities 31 that are respectively arranged on two opposite sides of the inner molding body 3.

In addition, a shape of the inner molding body 3 and a quantity of the concavities 31 can be adjusted or changed according to design requirements, but the present disclosure is not limited thereto. For example, in other embodiments of the present disclosure, the quantity of the concavities 31 of the inner molding body 3 can be at least one, and the inner molding body 3 can be in an arc shape.

As shown in FIG. 4 to FIG. 7, the positioning case 4 is fastened to the plug 1 and surrounds the plug 1, so that the insertion portion 11 of the plug 1 can be maintained to expose from the positioning case 4 by an insertion length L11 along the insertion direction S, and the insertion length L11 is within a range of 6.5 mm-6.8 mm. Accordingly, when the plug 1 of the angular connector 100 is inserted into the mating connector, the insertion portion 11 can be confirmed to firmly and electrically couple to the mating connector.

In the present embodiment, the assembling portion 12 of the plug 1 has a limiting step 121 not covered by the inner molding body 3, and the inner surface 41 of the positioning case 4 is restricted by the limiting step 121, so that the insertion portion 11 of the plug 1 is maintained to expose from the positioning case 4 by the insertion length L11 along the insertion direction S, but the present disclosure is not limited thereto.

Specifically, the positioning case 4 in the present embodiment is integrally formed as one piece structure. A width W4 of the positioning case 4 along the width direction W is within a range of 6.3 mm to 6.5 mm, and a length L4 of the positioning case 4 along the longitudinal direction L is within a range of 12.1 mm to 12.4 mm. The inner surface 41 of the positioning case 4 surroundingly defines a receiving space R, and the positioning case 4 has a thru-hole 42 and a plurality of fixing holes 43 that are in spatial communication with the receiving space R.

Moreover, the insertion portion 11 of the plug 1 passes through the thru-hole 42 of the positioning case 4, so that at least part of the inner molding body 3 is arranged in the receiving space R (i.e., the positioning case 4 can cover at least part of the outer surface of the inner molding body 3), and the positioning case 4 is preferably not connected to the inner molding body 3. A portion of the outer surface of the inner molding body 3 covered by the positioning case 4 has an area that is 1% to 30% (e.g., 3% to 8% in the present embodiment) of a total area of the outer surface of the inner molding body 3, but the present disclosure is not limited thereto.

In other words, when the positioning case 4 is fastened to the plug 1 and is exposed from the positioning case 4 by the insertion length L11, any one of the concavities 31 of the inner molding body 3 is partially arranged in the receiving space R, and the fixing holes 43 correspond in position to the inner molding body 3, so that the outer molding body 5 can be formed to firmly connect to the positioning case 4 and the inner molding body 3.

The outer molding body 5 covers and is connected to the inner molding body 3 and the buffering segment 23 of the transmission cable 2, and the inner molding body 3 in the present embodiment is entirely embedded in the outer molding body 5. Specifically, the concavities 31 of the inner molding body 3 are embedded in the outer molding body 5 (i.e., the concavities 31 are fully filled with and are connected to the outer molding body 5), thereby increasing the connection strength between the inner molding body 3 and the outer molding body 5. Moreover, the outer molding body 5 is formed to cover and be connected to the buffering segment 23 of the transmission cable 2, thereby preventing the buffering segment 23 from intensely bending so as to increase the service life of the transmission cable 2.

The outer molding body 5 is connected to the inner surface 41 of the positioning case 4, but is not connected to the insertion portion 11 of the plug 1. In the present embodiment, the outer molding body 5 is partially filled in the receiving space R of the positioning case 4, thereby connecting a portion of the assembling portion 12 of the plug 1 and a portion of the inner surface 41 of the positioning case 4.

Specifically, the outer molding body 5 has a plurality of posts 51 that are filled fully in the fixing holes 43, respectively (i.e., each of the posts 51 is gaplessly connected to an inner wall of the corresponding fixing hole 43), and each of the posts 51 does not protrude from the corresponding fixing hole 43, but the present disclosure is not limited thereto. For example, in other embodiments of the present disclosure, the positioning case 4 can have at least one fixing hole 43, and the outer molding body 5 has at least one post 51 that is filled fully in the at least one fixing hole 43.

Moreover, the outer molding body 5 and the positioning case 4 in the present embodiment are made of the same plastic material, and the outer surface 52 of the outer molding body 5 is flush with or coplanar with the outer surface 44 of the positioning case 4, so that the outer molding body 5 and the positioning case 4 of the angular connector 100 are formed similar to a one piece structure.

The connection portion of the outer surface 44 of the outer molding body 4 and the outer surface 52 of the positioning case 5 is defined as a ring-shaped boundary B, and the concavities 31 of the inner molding body 3 are arranged at an inner side of the ring-shaped boundary B. Accordingly, the portion with the stronger connection strength, between the inner molding body 3 and the outer molding body 5 corresponds in position to and is formed to support the connection portion of the outer molding body 5 and the positioning case 4, thereby effectively increasing the service life of the angular connector 100. Specifically, the outer molding body 5 and the positioning case 4 jointly define a corner structure having an angle σ that is greater than or equal to 90 degrees and that is less than 180 degrees. In the present embodiment, the angle σ of the corner structure is defined in a plane perpendicular to the width direction W. It should be noted that, the corner structure in the present embodiment is in an L-shape (e.g., the angle σ is substantially 90 degrees), but the present disclosure is not limited thereto. For example, in other embodiments of the present disclosure, the angle σ can be defined to be an inner edge of the corner structure, and an outer edge of the corner structure can be formed in any shape (e.g., an arc shape).

The above description describes the structure of the angular connector 100 of the present embodiment, and the following description describes a manufacturing method of the angular connector 100. The manufacturing method of the angular connector 100 includes a preparation step, a first injection step, a mediation step, and a second injection step, but the present disclosure is not limited thereto. In other words, the angular connector 100 can be manufactured by a method other than the manufacturing method of the present embodiment; or, the manufacturing method of the present embodiment can be adjusted to manufacture a product that is slightly different from the angular connector 100 of the present embodiment.

As shown in FIG. 4, the preparation step is implemented by providing a plug 1 and a transmission cable 2. Specifically, the plug 1 includes an insertion portion 11 and an assembling portion 12 connected to the transmission cable 11, and the plug 1 has an insertion slot 13 that is recessed in an end of the insertion portion 11 away from the assembling portion 12 and that extends along an insertion direction S.

As shown in FIG. 4, the first injection step is implemented by forming an inner molding body 3 to cover the assembling portion 12 and a portion of the transmission cable 2 adjacent to the assembling portion 12.

As shown in FIG. 3, the mediation step is implemented by fastening a positioning case 4 to the plug 1 so as to maintain the insertion portion 11 of the plug 1 to be exposed from the positioning case 4 by an insertion length L11 along the insertion direction S. Specifically, the insertion length L11 is within a range of 6.5 mm to 6.8 mm.

As shown in FIG. 1 and FIG. 3, the second injection step is implemented by forming an outer molding body 5 connected to the inner molding body 3 and an inner surface 41 of the positioning case 4, so that the outer molding body 5 and the positioning case 4 jointly define a corner structure. Specifically, the outer molding body 5 is not connected to the insertion portion 11 of the plug 1, and the corner structure has an angle σ that is greater than or equal to 90 degrees and that is less than 180 degrees.

Second Embodiment

Referring to FIG. 8 to FIG. 11, a second embodiment of the present disclosure is similar to the first embodiment of the present disclosure. For the sake of brevity, descriptions of the same components in the first and second embodiments of the present disclosure will be omitted herein, and the following description only discloses different features between the first and second embodiments.

In the present embodiment, the angle σ of the corner structure is defined in a plane perpendicular to the longitudinal direction L, thereby satisfying different design requirements. Specifically, the angle σ is greater than or equal to 90 degrees, and is less than 180 degrees. In the present embodiment, the angle σ is 90 degrees. In addition, the angular connector 100 of the present embodiment can be manufactured by implementing the manufacturing method of the first embodiment.

Third Embodiment

Figure 12:
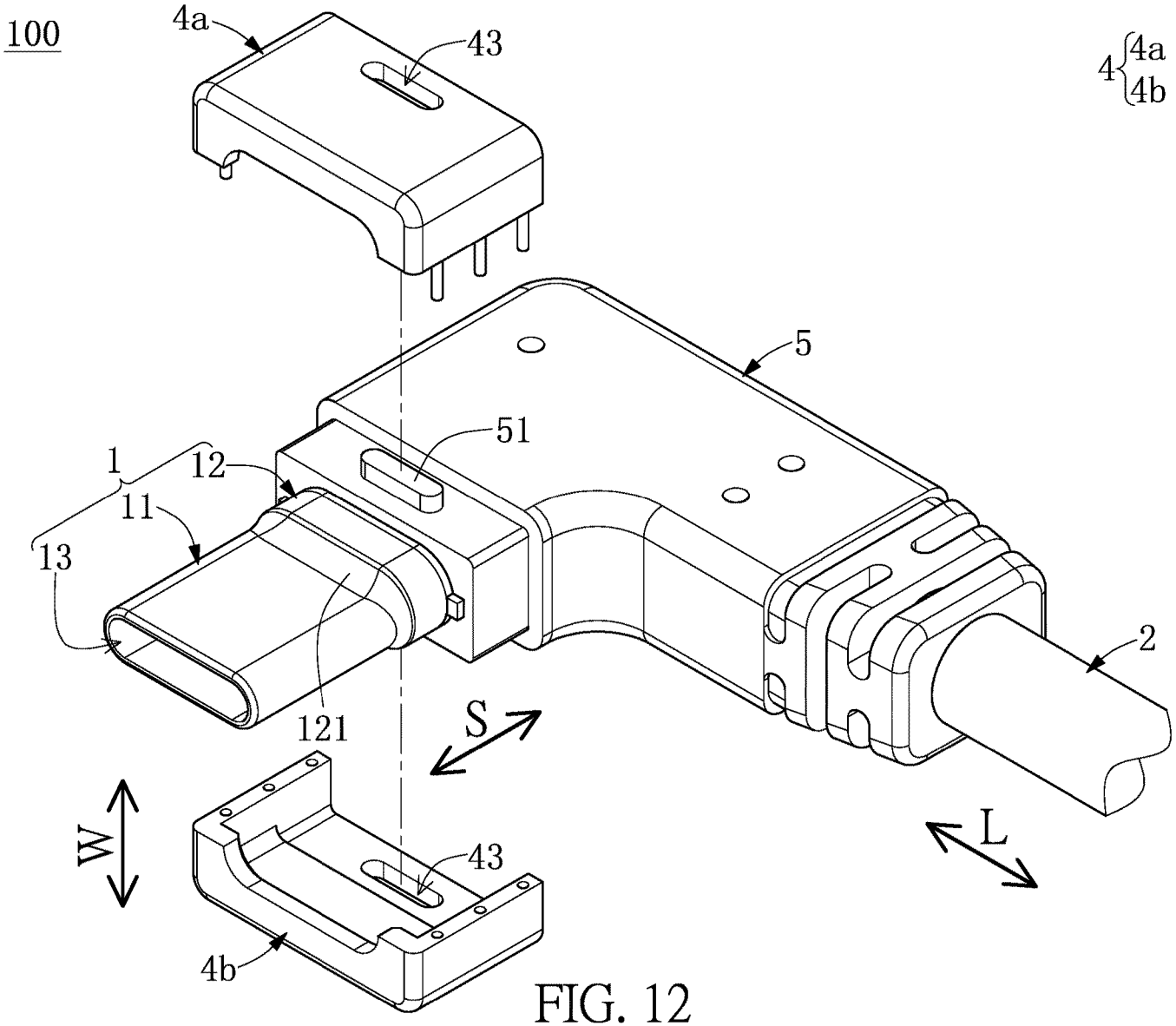
FIG. 12 is an exploded perspective view of an angular connector according to a third embodiment of the present disclosure.

Referring to FIG. 12, a third embodiment of the present disclosure is similar to the first embodiment of the present disclosure. For the sake of brevity, descriptions of the same components in the first and third embodiments of the present disclosure will be omitted herein, and the following description only discloses different features between the first and third embodiments.

In the present embodiment, the positioning case 4 can be formed by assembling a plurality of pieces, which includes an upper case 4*a* and a lower case 4*b* that is fastened to the upper case 4*a*, thereby satisfying different design requirements.

In conclusion, by virtue of "the angular connector" and "the manufacturing method" of the present disclosure, the positioning case is fastened to the plug and surrounds the plug, so that the insertion portion of the plug can be maintained to expose from the positioning case by an insertion length along the insertion direction, and the insertion length is within a range of 6.5 mm-6.8 mm. Accordingly, when the plug of the angular connector is inserted into the mating connector, the insertion portion can be confirmed to firmly and electrically couple to the mating connector.

Moreover, the inner molding body in the present embodiment is entirely embedded in the outer molding body, so that the concavities of the inner molding body are embedded in the outer molding body (i.e., the concavities are fully filled with and are connected to the outer molding body). Accordingly, the connection strength between the inner molding body and the outer molding body can be improved.

In addition, the connection portion, having a stronger strength, between the inner molding body and the outer molding body corresponds in position to and is formed to support the connection portion of the outer molding body and the positioning case (e.g., the concavities of the inner molding body are arranged at the inner side of the ring-shaped boundary), thereby effectively increasing the service life of the angular connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An angular connector, comprising:

a plug including an insertion portion and an assembling portion, wherein the plug has an insertion slot that is recessed in an end of the insertion portion away from the assembling portion and that extends along an insertion direction;

a transmission cable having an embedded segment, an exposed segment, and a buffering segment that connects the embedded segment and the exposed segment, wherein the embedded segment is connected to the assembling portion of the plug, and the transmission cable is electrically coupled to the plug;

an inner molding body covering the embedded segment and at least part of the assembling portion of the plug;

a positioning case fastened to the plug and surrounding the plug so as to maintain the insertion portion of the plug to be exposed from the positioning case by an insertion length along the insertion direction, wherein the insertion length is within a range of 6.5 mm to 6.8 mm; and an outer molding body covering and connected to the inner molding body and the buffering segment of the transmission cable, wherein the outer molding body is connected to an inner surface of the positioning case, but is not connected to the insertion portion of the plug, wherein the outer molding body and the positioning case jointly define a corner structure having an angle that is greater than or equal to 90 degrees and that is less than 180 degrees.

2. The angular connector according to claim 1, wherein the inner surface of the positioning case defines a receiving space, and at least part of the inner molding body is arranged in the receiving space, and wherein a portion of an outer surface of the inner molding body covered by the positioning case has an area that is 1% to 30% of a total area of the outer surface of the inner molding body.

3. The angular connector according to claim 1, wherein the outer molding body and the positioning case are made of the same plastic material and an outer surface of the outer molding body is flush with an outer surface of the positioning case.

4. The angular connector according to claim 3, wherein a connection portion of the outer surface of the outer molding body and the outer surface of the positioning case is defined as a ring-shaped boundary, and a portion of the inner molding body covering the at least part of the assembling portion has at least one concavity, and wherein the at least one concavity is arranged at an inner side of the ring-shaped boundary, and is embedded in the outer molding body.

5. The angular connector according to claim 1, wherein the inner surface of the positioning case defines a receiving space, the positioning case has at least one fixing hole in spatial communication with the receiving space, at least part of the inner molding body is filled in the receiving space, and the outer molding body has at least one post that is fully filled in and does not protrude from the at least one fixing hole.

6. The angular connector according to claim 5, wherein the positioning case is integrally formed as a one piece structure, the positioning case is not connected to the inner molding body, and the inner molding body is entirely embedded in the outer molding body.

7. The angular connector according to claim 1, wherein the plug defines a width direction and a longitudinal direction that are perpendicular to each other and that are perpendicular to the insertion direction, a width of the positioning case along the width direction is within a range of 6.3 mm to 6.5 mm, and the angle of the corner structure is defined in a plane perpendicular to the longitudinal direction.

8. The angular connector according to claim 1, wherein the plug defines a width direction and a longitudinal direction that are perpendicular to each other and that are perpendicular to the insertion direction, a width of the positioning case along the width direction is within a range of 6.3 mm to 6.5 mm, and the angle of the corner structure is defined in a plane perpendicular to the width direction.

9. The angular connector according to claim 1, wherein the corner structure is in a shape of the letter "L", the assembling portion of the plug has a limiting step that is not covered by the inner molding body, and the inner surface of the positioning case is limited by the limiting step, so that the insertion portion of the plug is maintained to be exposed from the positioning case by the insertion length along the insertion direction.

* * * * *